US005243771A

United States Patent [19]

Kretchman et al.

[11] Patent Number: 5,243,771

[45] Date of Patent: Sep. 14, 1993

[54] LATCHING FOR SIDE SWING DRYER DOOR

[75] Inventors: Gerald L. Kretchman, St. Joseph Township, Berrien County; James I. Czech, Lincoln Township, Berrien County, both of Mich.

[73] Assignee: Whirlpool Corporation, Benton Harbor, Mich.

[21] Appl. No.: 811,534

[22] Filed: Dec. 20, 1991

[51] Int. Cl.[5] ..... E05C 1/06; E05B 65/06

[52] U.S. Cl. ..... 34/108; 126/190; 220/315; 292/DIG. 69; 49/394

[58] Field of Search ..... 49/394; 34/242, 108; 62/265; 292/184, DIG. 69; 220/315; 126/190; 312/293.2, 8.15

[56] References Cited

U.S. PATENT DOCUMENTS

| | | | |
|---|---|---|---|
| 643,606 | 2/1900 | Rebbeck | 220/315 X |
| 1,771,184 | 7/1930 | McLaughlin . | |
| 2,526,532 | 10/1950 | Bedford, Jr. | 24/73 |
| 3,045,663 | 7/1962 | McDonnold | 126/190 |
| 3,261,628 | 7/1966 | Kesling | 292/70 |
| 3,520,568 | 7/1970 | White et al. | 292/255 |
| 4,272,111 | 6/1981 | Hammer, Jr. et al. | 292/17 |

*Primary Examiner*—William E. Wayner

*Attorney, Agent, or Firm*—Hill, Steadman & Simpson

[57] ABSTRACT

An improved latching configuration for a side swing door includes a cabinet enclosure with at least one side wall. An opening is formed in the side wall to provide access to an interior of the cabinet. A door is pivotably attached to the side wall to selectively open and close the opening upon a pivoting movement of the door. A latch assembly is provided on the door and/or the side wall for securing the door to the side wall in a closed position. The latch assembly is positioned between a location of attachment of the door to the side wall and a free edge of the door opposite the attachment location, preferably midway between those points.

17 Claims, 1 Drawing Sheet

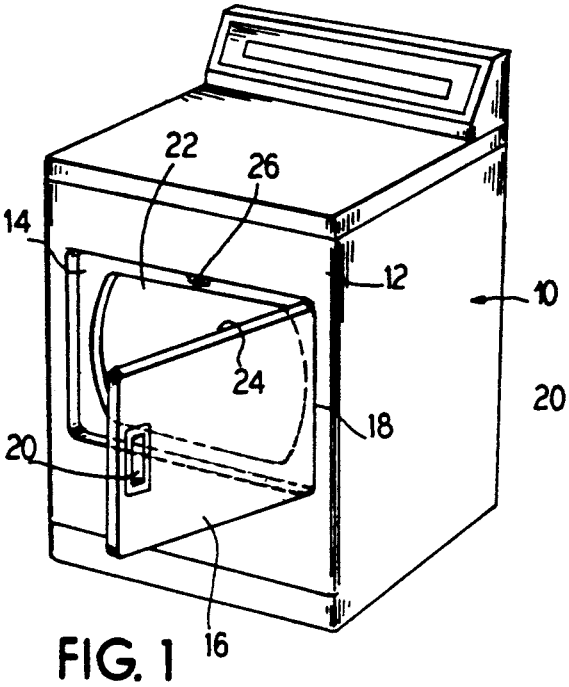
FIG. 1
FIG. 2
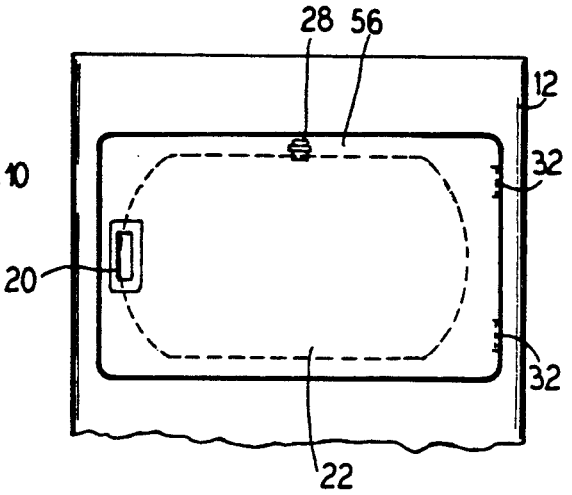
FIG. 3
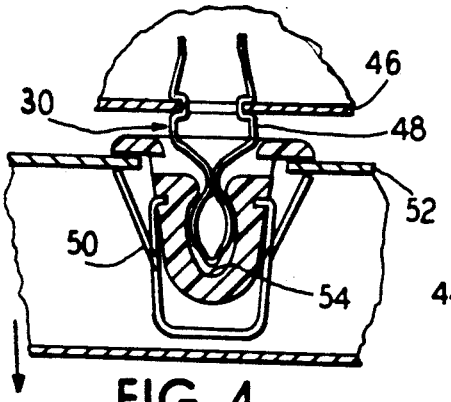
FIG. 4
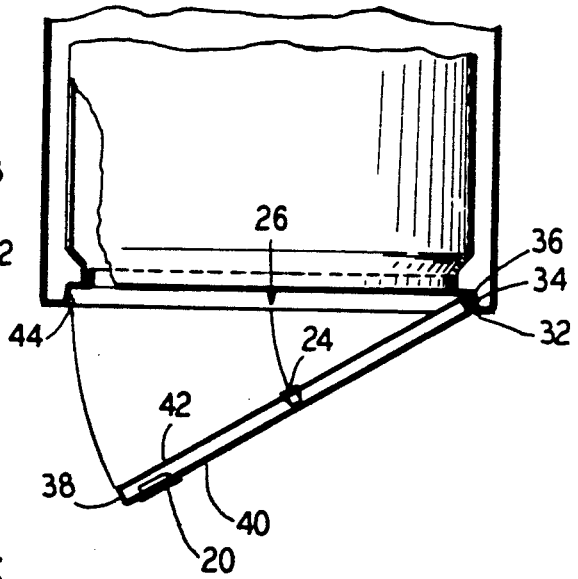
FIG. 5
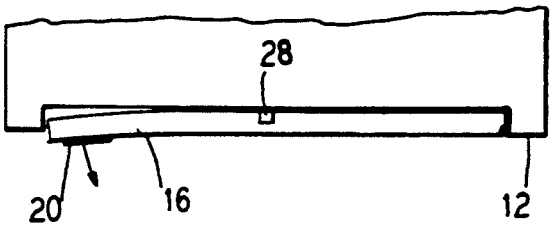

LATCHING FOR SIDE SWING DRYER DOOR

FIELD OF THE INVENTION

The present invention relates to a latching arrangement for a side swing dryer door.

BACKGROUND OF THE INVENTION

Conventional door latching systems for side swing doors of domestic appliances generally include a latch assembly provided at a free end of a side swing door, opposite a hinged end of the door. Typically, the latch assembly includes a strike and a catch assembly. The location of such a latch assembly is fully discussed in U.S. Pat. No. 3,520,568 to White et al.

However, placing the latch assembly along a side of the side swing door opposite a hinged side of the door causes a sudden snap to occur when the door handle is pulled and the strike is released from the catch assembly. Such a configuration can allow the side swing door to open when, for example, used in a dryer assembly where tumbling tennis shoes can bump against the inner door surface.

SUMMARY OF THE INVENTION

It is an object of the present invention to provide an improved latching configuration for a side swing door by relocating the latch assembly.

The above object is inventively achieved in an appliance including a cabinet enclosure with at least one side wall, or front panel. The cabinet enclosure has an opening formed in the side wall to provide access to an interior of the cabinet. A door is pivotably attached to the side wall to selectively open and close the opening upon a pivoting movement of the door. Further, a latch assembly is provided on the door and/or the side wall for securing the door to the sidewall in a closed position. The latch assembly is positioned between a location of attachment of the door to the side wall and a free edge of the door opposite the attachment location. The latch assembly can include a catch assembly member and a strike member, where one of the members is attached to the door and the other of the member is attached to the side wall. The strike member can include, for example, a resilient spring member. The catch assembly member can include, for example, a receptacle shaped to frictionally receive the spring member.

The improved latching configuration of the present invention can be embodied in a domestic appliance including a front panel having a recess formed therein to provide an access opening. A door, adapted to selectively open and close, is hinged to the front panel along a hinged side. A latch assembly is provided on the door and/or the recess for securing the door to the recess in a closed position. The latch assembly is positioned between the hinged side and a free side of the door, the free side of the door being opposite the hinged side of the door.

The positioning of the latching configuration of the present invention is preferably integrated into a dryer including a front panel. A generally rectangular recess is formed in the front panel. The recess has a centrally located, generally oval access opening. A generally rectangular door, adapted to selectively open and close, is connected to the recess on a hinged side. A latch assembly, including a strike and a catch, is centrally disposed along the door and the recess. The strike is disposed along the recess. The catch assembly is disposed along a side of the door adjacent to the hinged side and adapted to receive the strike and releasably retain the strike.

Due to the novel placement of the latch assembly, as the door is initially pulled open, the door flexes, bending along the side of the door, somewhat at the latch assembly location. This slight bending causes a "softening" of the sudden snap which occurs when the latching assembly releases. Thus, the door is somewhat easier to open than having a conventional latching system door. The novel placement of the latching assembly, between a hinged side and a free side of the door, reduces the tendency of the door to open when, for example, tumbling tennis shoes rub or bump against the inner door surface. This is particularly true when the dryer is in a drying mode, with heated air within the dryer causing the door to expand and thus slightly bow out between the attached or hinged location and the latching assembly.

Further, the novel location of the latch assembly reduces the likelihood of clothes being snagged on the latch assembly when loading and unloading a domestic appliance, such as a dryer.

BRIEF DESCRIPTION OF THE DRAWINGS

FIG. 1 illustrates a perspective view of a domestic appliance embodying a latch assembly in accordance with the principles of the present invention.

FIG. 2 illustrates a sectional view of an embodiment of the present invention.

FIG. 3 illustrates a top sectional view of the latch assembly of the present invention.

FIG. 4 illustrates a sectional view of a known latch assembly, preferably used in the embodiment of the present invention.

FIG. 5 illustrates a top sectional view of the improved latching configuration of the present invention, with the door in a closed position; and illustrates the small door deflection that occurs when an opening force is applied to the door handle.

DESCRIPTION OF THE PREFERRED EMBODIMENTS

As illustrated in FIG. 1, the improved latching configuration of the present invention can be embodied in a domestic appliance, such as a dryer 10. The dryer 10 includes a front panel, or side wall 12. The side wall 12 can be a vertical side wall. A generally rectangular recess 14 is formed in a front panel 12. A side swing door 16 is attached to the rectangular recess attached along a hinged side, or location of attachment, 18 at a lateral edge 36 of the door 16 (illustrated in FIG. 3). The side swing door 16 is adapted to selectively open and close. A handle 20 is provided for selectively opening and closing the side swing door 16.

Further, an access opening 22 is formed in the generally rectangular recess 14 for accessing the inside of the dryer 10. A latch assembly 28 (illustrated in FIG. 2), for securing the side swing door within the recess when the door 16 is in a closed position, is positioned substantially midway between the location of attachment 18 of the door 16 and a free edge 38 of the door 16 (illustrated in FIG. 3). The latch assembly 28 can include a catch assembly 24 and a strike 26. For example, the strike 26 can be arranged substantially centrally along a side of the recess 14 adjacent to the attachment location 18. The catch assembly 24 can be arranged along an inside 42 (illustrated in FIG. 3) of the side swing door 16, substantially centrally located at the top of the inside 42 of the side swing door 16.

FIG. 2 illustrates a preferred location of the latch assembly 28, along a top edge 56 of the door 16. The door 16 is connected to the recess 14 by hinges 32 to provide the attachment location 18. The handle 20 is centrally arranged on the outside 40 (illustrated in FIG. 3) of the door 16, opposite the hinged side 18. The latch assembly 28 is arranged midway between the hinged side 18 and the handle 20. The latch assembly 28 can include, for example, a conventional strike and catch assembly, as illustrated in FIG. 4, a magnetic assembly, or any other suitable assembly for releasably securing the door 16 to the recess 14.

FIG. 3 illustrates the location of the latching configuration with respect to the hinged side 18 and the handle 20, with the door 16 ajar. The door 16 is connected to a first recess side 34 and to the lateral edge 36 of the door 16 by the hinge 32. The handle 20 is arranged on the outside 40 of the door 16 near the free edge 38 of the door 16. A catch 26 is arranged midway between the lateral edge 36 of the door 16 and the free edge 38 of the door 16, along the inside 42 of the door 16. The strike 24 is arranged substantially midway between the first recess side 34 and a second recess side wall 44.

FIG. 4 illustrates a known latch assembly 30 for securing a door to a cabinet. The known latch assembly 30 includes a strike 48 arranged in a front panel 46 of, for example, a cabinet. A catch assembly 50 is arranged in an inner door 52. The strike 48 is releasably retained in a cavity 54 of the catch assembly 50. The strike 48 is released from the catch assembly 50 by applying an outward force in the direction of the arrow shown in FIG. 4. Such a known latch assembly is the type preferably used in the embodiment of the present invention.

FIG. 5 illustrates, in exaggeration, the flexibility of the door 16 with the novel location of the latch assembly 28. Due to the novel placement of the latch assembly 28, as the door 16 is initially pulled open, the door flexes, bending somewhat at the latch assembly 28 location, along the arrow shown in FIG. 5.

It is also contemplated that the latch assembly can be located below the handle 20, substantially centrally between the handle 20 and the hinged location 18 along recess 14.

With the latch assembly 28 positioned approximately midway along the length of the door 16, the user of the appliance 10 is given a mechanical advantage in separating the components of the latch assembly 28. Thus, a latch assembly having greater holding strength than that of latching assemblies previously provided can be utilized without increasing the force required, at the handle, for opening the door. Such increase in holding strength further provides enhanced integrity of the latching system in a closed position during operation of the appliance.

Also, since the latch assembly is mounted centrally on the door, when the door expands due to heat within the appliance, the amount of bending of the door will be reduced by approximately one half, with the free half of the door, free to expand without restraint by the latch assembly. This further reduces the susceptibility of the door to door opening forces such as impact of items tumbling within the dryer drum.

Although the present has been described with reference to the specific embodiment of the improved latch assembly in a domestic dryer, those of skill in the art will recognize that changes may be made thereto without departing from the scope and spirit of the invention as set forth in the appended claims.

The embodiments of the invention in which an exclusive property or privilege is claimed are defined as follows:

1. An appliance including means for providing heat therein comprising:
   - a cabinet enclosure with at least one side wall;
   - an opening formed in said side wall to provide access to an interior of said cabinet;
   - a door pivotally attached to said side wall to selectively open and close said opening upon a pivoting movement of said door;
   - latch means, provided on at least one of said door and said side wall, for securing said door to said side wall in a closed position, said latch means being positioned between a location of attachment of said door to said side wall and a free edge of said door opposite said attachment location, said latch means disposed along an edge of said door closer to a center of said door than to said location of attachment or said free edge.

2. An appliance according to claim 1, further comprising at least one hinge for pivotally attaching said door to said side wall.

3. An appliance according to claim 1, said latch means further comprising a strike and a catch assembly for releasably retaining said strike.

4. An appliance according to claim 1, wherein said latch means is positioned substantially midway between said location of attachment of said door and said free edge of said door.

5. An appliance according to claim 1, wherein said side wall is a vertical side wall, said location of attachment is at a lateral edge of said door, and said latch means is positioned along a top edge of said door.

6. An appliance according to claim 1, wherein said latch means comprises a strike member and a catch assembly member, wherein one of said members is attached to said door and the other of said members is attached to said side wall.

7. An appliance according to claim 6, wherein said strike member comprises a resilient spring member and said catch assembly member comprises a receptacle shaped to frictionally receive said spring member.

8. A domestic appliance including means for providing heat therein comprising:
   - a front panel;
   - a recess formed in said front panel having an access opening;
   - a door, adapted to selectively open and close;
   - hinge means connecting said door to said front panel, for securing said door to said front panel along a hinged side; and
   - latch means provided on at least one of said door and said recess, for securing said door to said recess in a closed position, said latch means being positioned between said hinged side and a free edge of said door opposite said hinged side, said latch means disposed along an edge of said door closer to a center of said door than to said location of attachment or said free edge.

9. A domestic appliance according to claim 8, said hinge means further comprising at least one hinge for securing said door to said front panel along said hinged side.

10. A domestic appliance according to claim 8, said latch means further comprising a strike and a catch assembly for releasably retaining said strike.

11. A domestic appliance according to claim 8, wherein said latch means is positioned substantially midway between said hinged side of said door and said free edge of said door.

12. A domestic appliance according to claim 8, wherein said recess is a vertical side wall, said hinged side is at a lateral edge of said door, and said latch means is positioned along a top edge of said door.

13. A domestic appliance according to claim 8, said latch means comprising a strike member and a catch member, wherein one of said members is attached to said door and the other of said members is attached to said recess.

14. A domestic appliance according to claim 13, wherein said strike member comprises a resilient spring member and said catch member comprises a receptacle shaped to frictionally receive said spring member.

15. A dryer including a drying drum capable of tumbling articles therein comprising:

a front panel;

a generally rectangular recess formed in said front panel having a centrally located, generally oval access opening;

a generally rectangular door, adapted to selectively open and close;

at least one hinge connecting said door to said recess along a hinged side;

a strike disposed along said recess; and a catch assembly, centrally disposed along a side of said door adjacent to said hinged side adapted to receive said strike and releasably retain said strike, said latch means disposed along an edge of said door closer to a center of said door than to said location of attachment or said free edge.

16. A dryer according to claim 15, wherein said recess is a vertical side wall, said hinged side is at a lateral edge of said door, said catch assembly is disposed along a top edge of said door, and said strike is disposed substantially midway between a first recess side and a second recess side.

17. A dryer according to claim 15, wherein said strike comprises a resilient spring member and said catch assembly comprises a receptacle shaped to frictionally receive said spring member.

* * * * *